US006551202B1

(12) United States Patent
Yoshida

(10) Patent No.: US 6,551,202 B1
(45) Date of Patent: Apr. 22, 2003

(54) MULTI-PIECE SOLID GOLF BALL

(75) Inventor: Kazunari Yoshida, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/671,994

(22) Filed: Sep. 29, 2000

(30) Foreign Application Priority Data

Sep. 30, 1999 (JP) ..... 11-279107
Jun. 22, 2000 (JP) ..... 2000-187718

(51) Int. Cl.[7] ..... A63B 37/04; A63B 37/06
(52) U.S. Cl. ..... 473/376; 473/371
(58) Field of Search ..... 473/351, 367, 473/368, 370, 371, 374, 376, 377

(56) References Cited

U.S. PATENT DOCUMENTS

| | | | | |
|---|---|---|---|---|
| 5,002,281 A | | 3/1991 | Nakahara et al. | |
| 5,711,723 A | * | 1/1998 | Hiraoka et al. | 473/374 |
| 5,782,707 A | | 7/1998 | Yamagishi et al. | |
| 5,820,487 A | | 10/1998 | Nakamura et al. | |
| 5,830,085 A | * | 11/1998 | Higuchi et al. | 473/373 |
| 5,830,086 A | * | 11/1998 | Hayashi et al. | 473/376 |
| 6,045,460 A | * | 4/2000 | Hayashi et al. | 473/376 |
| 6,213,896 B1 | * | 4/2001 | Higuchi et al. | 473/374 |

FOREIGN PATENT DOCUMENTS

| | | |
|---|---|---|
| GB | 2232162 | 5/1990 |
| GB | 2342295 | 12/2000 |
| JP | 8-332247 | 12/1996 |
| JP | 9-239067 | 9/1997 |
| JP | 9-313643 | 12/1997 |

* cited by examiner

*Primary Examiner*—Paul T. Sewell
*Assistant Examiner*—Alvin A. Hunter, Jr.
(74) *Attorney, Agent, or Firm*—Birch, Stewart, Kolasch & Birch, LLP

(57) ABSTRACT

A multi-piece solid golf ball core with inner layer and outer layer, and at least one layer of cover on the core, with an inner layer core diameter of 24 to 40 mm and a center hardness in JIS-C hardness of 40 to 60; a surface hardness in JIS-C hardness of the inner layer core higher than the center hardness by 20 to 40; the outer layer core thickness of 2.0 to 7.0 mm and a surface hardness in JIS-C hardness of 75 to 90; the outermost layer of the cover 1.0 to 2.0 mm thick and a Shore D of 40 to 63; and the golfball satisfies formula: $0 \leqq \{T(C-B)-(60-A)\} \leqq 10$; where:

A, B represent inner layer core's center hardness, surface hardness, respectively, JIS-C;

C represents surface hardness (JIS-C) of outer layer core;

T represents thickness of outer layer core.

3 Claims, 3 Drawing Sheets

MULTI-PIECE SOLID GOLF BALL

FIELD OF THE INVENTION

The present invention relates to a multi-piece solid golf ball. More particularly, it relates to a multi-piece solid golf ball which has excellent flight performance by accomplishing high launch angle and low spin amount when hit by a driver or a long iron club or a middle iron club; has good controllability by accomplishing high spin amount when hit by a short iron club or approach-shot; has light and good shot feel by accomplishing good rebound characteristics when hit by a driver or a long iron club or a middle iron club; and has good controllability by accomplishing large contact area of the ball with a club face and light and good shot feel when hit by a short iron club or approach-shot.

BACKGROUND OF THE INVENTION

Amateur golfers generally regard flight distance as most important factor for golf balls and use a golf ball having good rebound characteristics and little spin amount, such as a solid golf ball, by choice. On the other hand, professional golfers and high level-amateur golfers generally regard controllability as most important factor for golf balls, and regard soft and good shot feel and flight performance as the next important factor for golf balls. Therefore they have mainly used thread wound golf balls, which have good controllability and soft and good shot feel. However, since the thread wound golf ball has a structure easily putting spin thereon, there has been a problem that the spin amount is large when hit by any type of golf club, which reduces the flight distance. In order to solve the problem, many solid golf balls having good shot feel and excellent flight performance while maintaining good controllability have been proposed in Japanese Patent Kokai Publication Nos. 239067/1997, 332247/1996, 313643/1997 and the like.

Japanese Patent Kokai Publication No. 239067/1997 suggests a two-piece solid golf ball comprising a core and a cover. The core has a surface hardness in JIS-C hardness of not more than 85, a center hardness of the core is lower than the surface hardness of the core by 8 to less than 20. A hardness of from the surface to 5 mm from the surface of the core is lower than a surface hardness of the core by not more than 8. A hardness of the cover is higher than the surface hardness of the core by 1 to 15. A thickness of the cover is 1.5 to 1.95 mm, and a number of dimples is 360 to 450.

Japanese Patent Kokai Publication No. 332247/1996 suggests a three-piece solid golf ball comprising a core having a two-layer structure of an inner core and outer core, and a cover. The inner core has a diameter of 25 to 37 mm, a center hardness in JIS-C hardness of 60 to 85 and a hardness difference in JIS-C hardness between the center point and surface of the inner core of not more than 4, the outer core has a surface hardness in JIS-C hardness of 75 to 90, and the cover has a flexural modulus of 1,200 to 3,600 kg/cm$^2$.

Japanese Patent Kokai Publication No. 313643/1997 suggests a three-piece solid golf ball that an intermediate layer is placed between a core and a cover. The core has a center hardness in JIS-C hardness of not more than 75, a surface hardness in JIS-C hardness of not more than 85, the surface hardness is higher than the center hardness by 5 to 25, a hardness of the intermediate layer is higher than the surface hardness of the core by less than 10, and a hardness of the cover is higher than that of the intermediate layer.

In the golf balls of the above publications, the flight performance when hit by a driver is improved, but the spin amount is large, which reduces flight distance, when hit by a long iron club or middle iron club still in need of long flight distance. In addition, the shot feel of the golf balls is hard or heavy in order to improve the flight distance, and good shot feel is not sufficiently obtained.

OBJECTS OF THE INVENTION

A main object of the present invention is to provide a multi-piece solid golf ball having excellent flight performance, good controllability and good shot feel.

According to the present invention, the object described above has been accomplished by providing a multi-piece solid golf ball comprising a core composed of an inner layer core and an outer layer core and at least one layer of a cover formed on the core, and adjusting a diameter and center hardness of the inner layer core, a thickness and surface hardness of the outer layer core, a hardness distribution of the core, and a thickness and hardness of the cover to specified ranges, thereby providing a multi-piece solid golf ball having excellent flight performance, good controllability and good shot feel.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

The present invention provides a multi-piece solid golf ball comprising;

a core composed of an inner layer core and an outer layer core formed on the inner layer, and at least one layer of a cover formed on the core, wherein the inner layer core has a diameter of 24 to 40 mm and a center hardness in JIS-C hardness of 40 to 60, a surface hardness in JIS-C hardness of the inner layer core is higher than the center hardness by 20 to 40, the outer layer core has a thickness of 2.0 to 7.0 mm and a surface hardness in JIS-C hardness of 75 to 90, the outermost layer of the cover has a thickness of 1.0 to 2.0 mm and a Shore D of 40 to 63, and assuming that the center hardness and surface hardness in JIS-C hardness of the inner layer core are represented as A and B respectively, and the surface hardness in JIS-C hardness and the thickness of the outer layer core are represented as C and T respectively, the golf ball satisfies the following formula:

$$0 \leqq \{T(C-B)-(60-A)\} \leqq 10.$$

In order to practice the present invention suitably, it is desired that the difference between the surface hardness of the outer layer core and an inner hardness at the central point in the thickness of the outer layer core is not more than 2, the difference (C−B) between the surface hardness of the outer layer core (C) and the surface hardness of the inner layer core (B) is within the range of 0 to 20, and the cover has a single-layered structure.

In the golf ball of the present invention, high launch angle and low spin amount are basically accomplished by adjusting a difference between a surface hardness and center hardness of the inner layer to the range of 20 to 40, thereby improving the flight performance. However, when hit by an iron club, the technical effect is not sufficiently obtained. When hit at approach shot, the technical effect is not only obtained but also the controllability is degraded and the shot feel is heavy and poor. In addition, the technical effect of accomplishing high launch angle and low spin amount when hit by an iron club is obtained by adjusting the center hardness of the inner layer core to the range of 40 to 60, which is low. However, the shot feel is further heavy and poor, and the controllability at approach shot is not improved, and rebound characteristics are also degraded. Therefore an improvement of the controllability at approach shot, restraint of the deterioration of the rebound characteristics, and light and good shot feel are accomplished by adjusting a product {T(C−B)} of the thickness of the outer layer core (T) and the difference (C−B) between the surface hardness of the outer layer core (C) and that of the inner layer core (B) to a specified range so as to satisfy the following formula: $0 \leqq \{T(C-B)-(60-A)\} \leqq 10$.

DETAILED DESCRIPTION OF THE INVENTION

Figure 1:
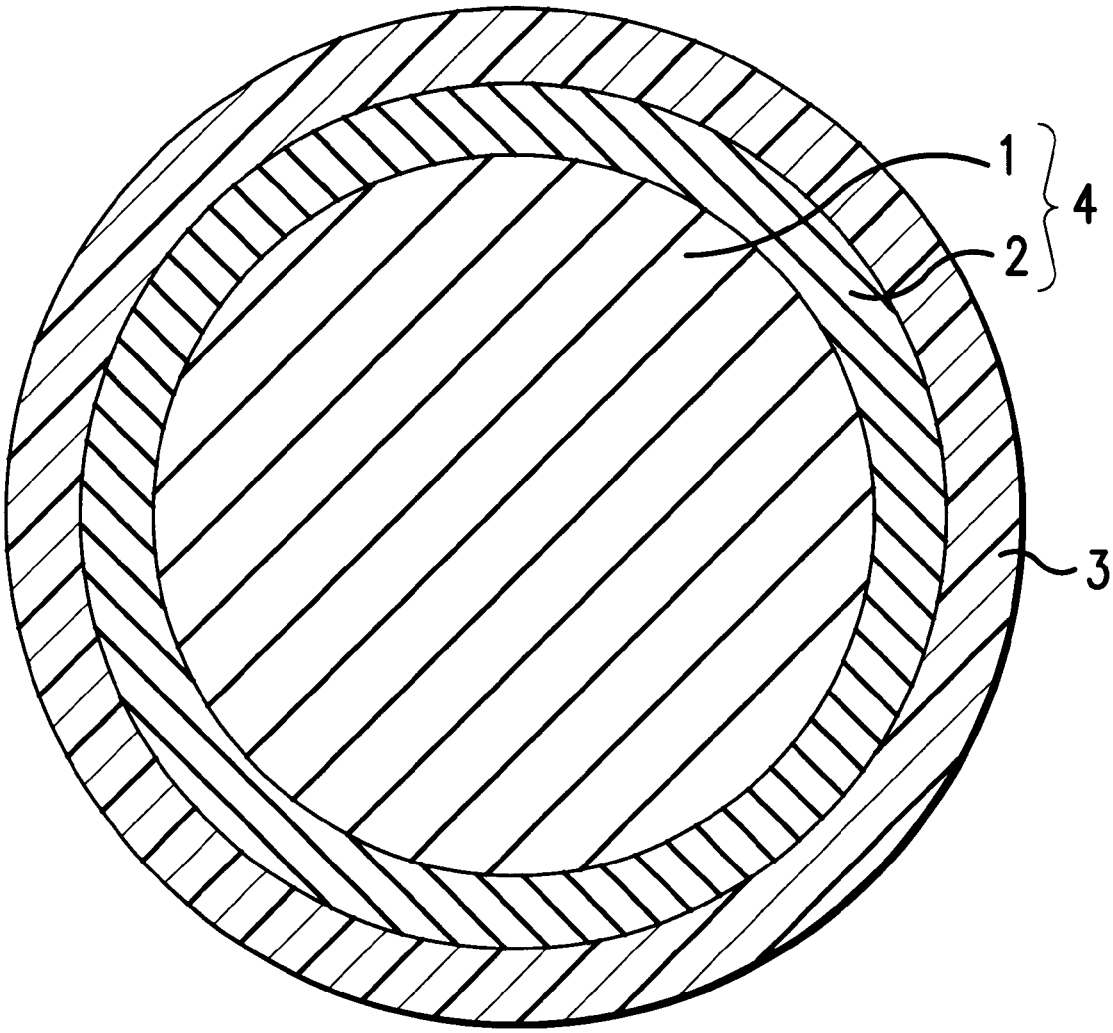
FIG. 1 is a schematic cross section illustrating one embodiment of the golf ball of the present invention.

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 4 composed of an inner layer core 1 and an outer layer core 2 formed on the inner layer, and at least one layer of cover 3 covering the core. In order to explain the golf ball of the present invention simply, a golf ball having one layer of cover 3 will be used hereinafter for explanation. However, the golf ball of the present invention may be applied for the golf ball having two or more layers of cover.

The core 4, including the inner layer core 1 and the outer layer core 2, is obtained by press-molding a rubber composition. The rubber composition essentially contains a base rubber, a co-crosslinking agent, an organic peroxide, a filler, an antioxidant and the like.

The base rubber may be natural rubber and/or synthetic rubber, which has been conventionally used for golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like in amount of 0 to 50 parts by weight based on 100 parts by weight of the base rubber.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and acrylic ester or methacrylic ester and the like. Preferred co-crosslinking agent is zinc acrylate because it imparts high rebound characteristics to the resulting golf ball. The amount of the co-crosslinking in the rubber composition is from 10 to 50 parts by weight, preferably from 20 to 40 parts by weight, based on 100 parts by weight of the base rubber. When the amount of the co-crosslinking is larger than 50 parts by weight, the core is too hard, and the shot feel is poor. On the other hand, when the amount of the co-crosslinking is smaller than 10 parts by weight, it is required to increase an amount of the organic peroxide in order to impart a desired hardness to the core. Therefore, the rebound characteristics are degraded, which reduces the flight distance.

The organic peroxide includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.3 to 3.0 parts by weight, preferably 0.4 to 2.0 parts by weight, based on 100 parts by weight of the base rubber. When the amount of the organic peroxide is smaller than 0.3 parts by weight, the core is too soft, and the rebound characteristics are degraded, which reduces the flight distance. On the other hand, when the amount of the organic peroxide is larger than 3.0 parts by weight, it is required to decrease an amount of the co-crosslinking agent in order to impart a desired hardness to the core. Therefore, the rebound characteristics are degraded, which reduces the flight distance.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and mixtures thereof. The amount of the filler is 2 to 50 parts by weight, preferably 3 to 35 parts by weight, based on 100 parts by weight of the base rubber. When the amount of the filler is smaller than 2 parts by weight, it is difficult to adjust the weight of the resulting golf ball. On the other hand, when the amount of the filler is larger than 50 parts by weight, the weight ratio of the rubber component in the core is small, and the rebound characteristics reduce too much.

The rubber composition for the core of the golf ball of the present invention can contain other components, which have been conventionally used for preparing the core of solid golf balls, such as organic sulfide compound, antioxidant or peptizing agent. If used, the amount of the antioxidant is preferably 0.1 to 1.0 parts by weight, that of the peptizing agent is preferably 0.1 to 5.0 parts by weight, and that of the organic sulfide compound is preferably 0.1 to 5.0 parts by weight, based on 100 parts by weight of the base rubber.

Figure 2:
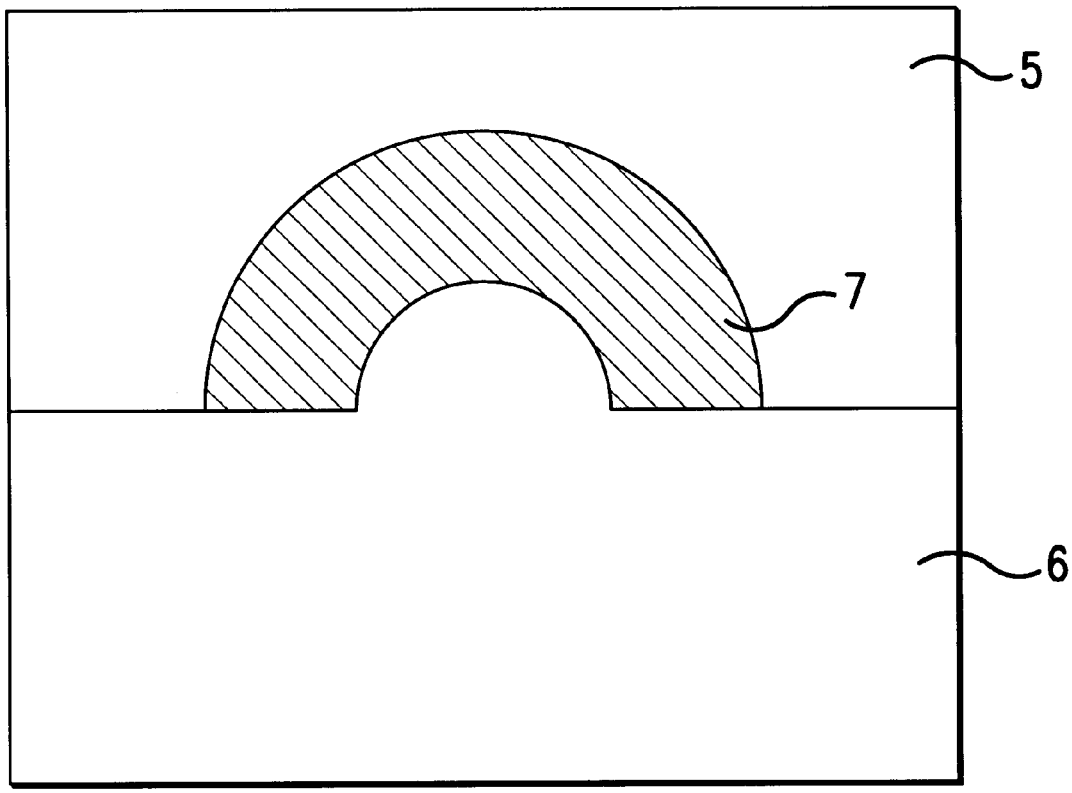
FIG. 2 is a schematic cross section illustrating one embodiment of a mold for molding a semi-spherical half-shell for the outer layer core of the golf ball of the present invention.
Figure 3:
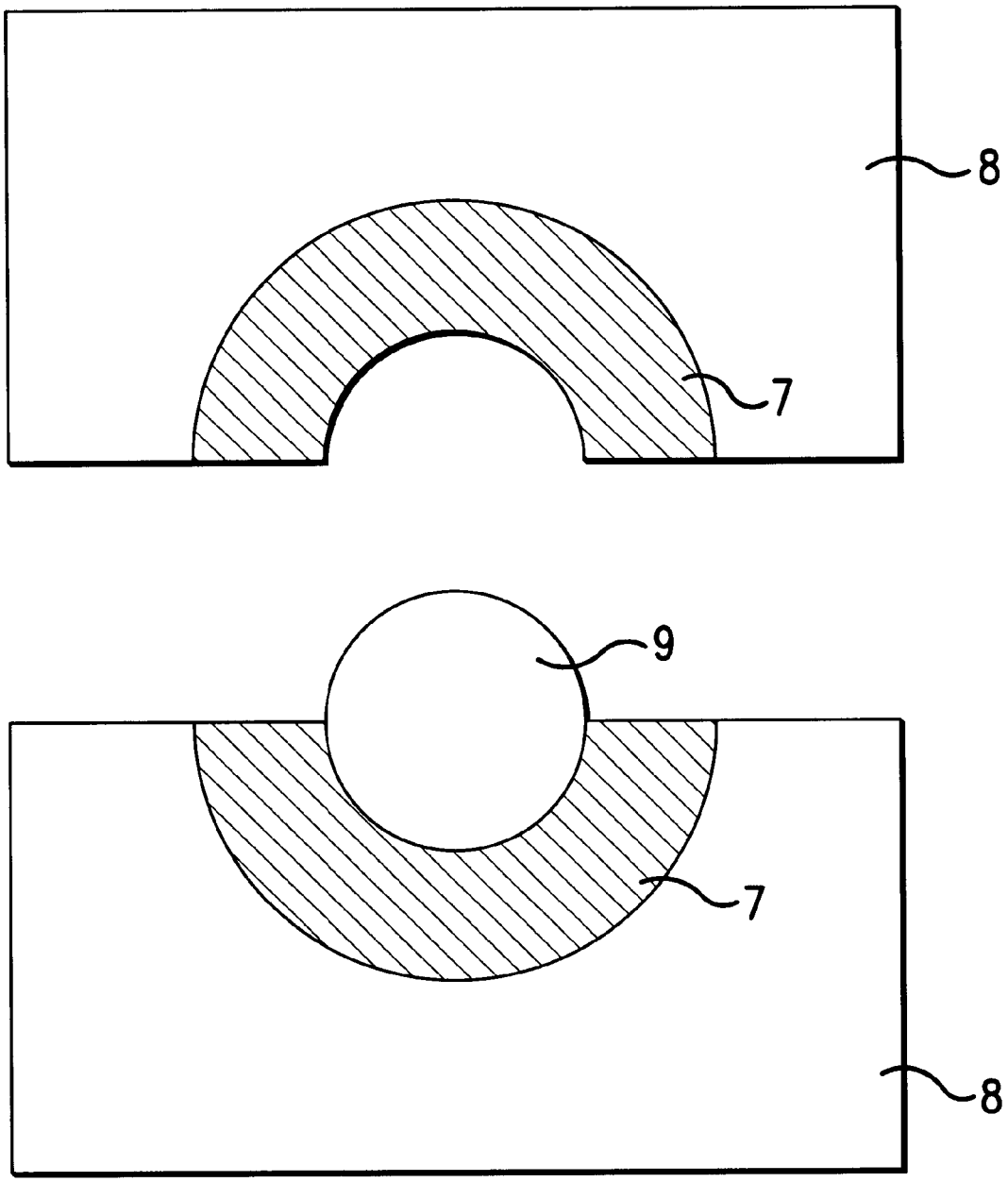
FIG. 3 is a schematic cross section illustrating one embodiment of a mold for molding the core of the golf ball of the present invention.

The process of producing the core of the golf ball of the present invention will be explained with reference to FIG. 2 and FIG. 3. FIG. 2 is a schematic cross section illustrating one embodiment of a mold for molding a semi-spherical half-shell used for the golf ball of the present invention. FIG. 3 is a schematic cross section illustrating one embodiment of a mold for molding a core of the golf ball of the present invention. The rubber composition for the inner layer core is mixed, and press-molded in a mold, which is composed of an upper mold and a lower mold having a semi-spherical cavity, at 140 to 180° C. for 10 to 60 minutes to prepare a vulcanized spherical molded article for the inner layer core. The rubber composition for the outer layer core then is mixed, and press-molded using a mold having a semi-spherical cavity 5 and a male plug mold 6 having a semi-spherical convex having the same diameter as the vulcanized spherical molded article for the inner layer core as described in FIG. 2 to obtain an unvulcanized semi-spherical half-shell 7 for the outer layer core. The vulcanized molded article for the inner layer core 9 is covered with the two semi-spherical half-shells 7 for the outer layer core, and then press-molded at 140 to 180° C. for 10 to 60 minutes in a mold 8 as described in FIG. 3 to prepare a two-layer structured core 4 comprising the inner layer core 1 and the outer layer core 2 formed on the inner layer core.

In the golf ball of the present invention, it is required that the inner layer core have a diameter of 24 to 40 mm, preferably 26 to 37 mm, more preferably 28 to 34 mm. When the diameter is smaller than 24 mm, the technical effects accomplished by the presence of the inner layer core is not sufficiently obtained. On the other hand, when the diameter is larger than 40 mm, it is difficult to adjust the outer layer core or the cover to a desired thickness.

In the golf ball of the present invention, it is required that the inner layer core have a center hardness in JIS-C hardness of 40 to 60, preferably 45 to 59, more preferably 50 to 58. When the center hardness is lower than 40, the resulting golf ball is too soft, and the rebound characteristics are degraded, which reduces the flight distance, and the shot feel is heavy. On the other hand, when the hardness is higher than 60, high launch angle is not sufficiently obtained when hit by a driver or middle iron club, which reduces the flight distance.

In the golf ball of the present invention, it is desired that the outer layer core have the surface hardness in JIS-C hardness of 70 to 90, preferably 72 to 88, more preferably 75 to 86. When the surface hardness is lower than 70, the shot feel is heavy and poor, and the rebound characteristics are degraded, which reduces the flight distance. On the other hand, when the hardness is higher than 90, the shot feel is hard and poor.

In the golf ball of the present invention, it is required that the difference (B−A) between the surface hardness of the inner layer core (B) and the center hardness of the inner layer core (A) be within the range of 20 to 40, preferably 22 to 35, more preferably 25 to 30. When the hardness difference is smaller than 20, high launch angle is not sufficiently obtained, which reduces the flight distance. On the other hand, when the hardness difference is larger than 40, high rebound characteristics are not sufficiently obtained, which reduces the flight distance, and the shot feel is heavy and poor.

The term "surface hardness of the inner layer core" as used herein means the hardness measured at the surface of the inner layer core, which is formed by press-molding as described above, before covering the outer layer core thereon. The term "center hardness of the inner layer core" as used herein means the hardness determined by cutting the inner layer core into two equal parts and then measuring a hardness at the central point of the section.

In the golf ball of the present invention, it is required that the outer layer core 2 have a thickness of 2.0 to 7.0 mm, preferably 2.0 to 5.5 mm, more preferably 2.0 to 4.0 mm. When the thickness is smaller than 2.0 mm, the technical effects accomplished by the presence of the outer layer core is not sufficiently obtained. Therefore the rebound characteristics are not sufficiently obtained, which reduces the flight distance. On the other hand, when the thickness is larger than 7.0 mm, it is difficult to adjust the inner layer core or the cover to a desired thickness. Therefore it is desired that the core having a two-layer structure, which is formed by integrally press-molding the inner layer core and the outer layer core, have a diameter of 34.5 to 41.0 mm, preferably 36.5 to 41.0 mm, more preferably 38.5 to 41.0 mm. When the diameter is smaller than 34.5 mm, or larger than 41.0 mm, it is difficult to adjust the cover to a desired thickness.

In the golf ball of the present invention, it is desired that the outer layer core have the surface hardness in JIS-C hardness of 75 to 90, preferably 77 to 88, more preferably 80 to 86. When the surface hardness is lower than 75, the launch angle is low and the rebound characteristics are degraded, which reduces the flight distance. On the other hand, when the hardness is higher than 90, the core is too hard, and the shot feel is poor.

In the golf ball of the present invention, in addition, it is desired that a hardness measured at any portion in the outer layer core be substantially the same. To be concrete, it is desired that the difference between the surface hardness of the outer layer core and an inner hardness at the central point in the thickness of the outer layer core be not more than 2, preferably not more than 1.5, more preferably not more than 1.0. When the outer layer core has a hardness distribution so as to decrease the hardness from the surface to the inner portion of the outer layer core in order, the rebound characteristics are degraded and the launch angle is low, which reduces the flight distance. On the other hand, when the outer layer core has a hardness distribution so as to increase the hardness from the surface to the inner portion of the outer layer core in order, the spin amount when hit by a middle iron club is high, which reduces the flight distance. The term "a surface hardness of the outer layer core" as used herein means the surface hardness of the core having a two-layered structure, which is formed by integrally press-molding the inner layer core and the outer layer core. The term "an inner hardness of the outer layer core" as used herein means the hardness determined by cutting the core having a two-layered structure into two equal parts and then measuring a hardness at the central point in the thickness of the outer layer core in section.

In the golf ball of the present invention, it is desired that the surface hardness of the outer layer core be higher than that of the inner layer core by 0 to 20, preferably 0 to 15, more preferably 0 to 10. When the hardness difference is smaller than 0, the rebound characteristics are not sufficiently obtained, which reduces the flight distance, and the shot feel heavy and poor. On the other hand, when the hardness difference is larger than 20, the shot feel is hard or heavy, and poor.

In the golf ball of the present invention, when assuming that the center hardness and surface hardness in JIS-C hardness of the inner layer core are represented as A and B respectively, and the surface hardness in JIS-C hardness and the thickness of the outer layer core are represented as C and T respectively, it is required that the value of $\{T(C-B)-(60-A)\}$ be within the range of 0 to 10, preferably 1 to 8, more preferably 2 to 7. When the value is smaller than 0, the rebound characteristics are not sufficiently obtained, which reduces the flight distance, and the shot feel is heavy and poor. On the other hand, when the value is larger than 10, the shot feel is hard or heavy, and poor.

The outer layer core 2 of the golf ball of the present invention, which is the same as the inner layer core 1, is obtained by press-molding a rubber composition. The rubber composition essentially contains a base rubber, a co-crosslinking agent, an organic peroxide, a filler, an antioxidant and the like. Since the outer layer core 2 is formed from the vulcanized rubber composition, which is not thermoplastic resin, such as ionomer resin, thermoplastic elastomer, diene copolymer and the like, the rebound characteristics are improved and the shot feel is good. In addition, since both the inner layer core 1 and the outer layer core 2 are formed from the same vulcanized rubber composition, the adhesion between the inner layer core 1 and the outer layer core 2 is excellent, and the durability is improved. Rubber, when compared with resin, has a little deterioration of performance at low temperature lower than room temperature as known in the art, and thus the outer core of the present invention formed from the rubber has excellent rebound characteristics at low temperature.

At least one layer of cover 3 is then covered on the core 4. In the golf ball of the present invention, it is required that the outmost layer of the cover 3 have a thickness of 1.0 to 2.0 mm, preferably 1.3 to 2.0 mm, more preferably 1.5 to 2.0 mm. When the thickness is smaller than 1.0 mm, the controllability is sufficiently obtained. On the other hand, when the thickness is larger than 2.0 mm, the flight distance is sufficiently obtained.

In the golf ball of the present invention, it is required that the outmost layer of cover 3 have a surface hardness in Shore D hardness of 40 to 63, preferably 45 to 61, more preferably 50 to 58. When the hardness is smaller than 40, the rebound characteristics are degraded, which reduces the flight distance. On the other hand, when the hardness is larger than 63, the controllability (spin amount) is sufficiently obtained.

The cover 3 of the present invention contains thermoplastic resin, particularly ionomer resin, which has been conventionally used for the cover of golf balls, as a base resin. The ionomer resin may be a copolymer of ethylene and α,β-unsaturated carboxylic acid, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like.

The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn 6320 and the like. Examples of the ionomer resins, which are commercially available from Exxon Chemical Co., include Iotek 7010, Iotek 8000 and the like. These ionomer resins may be used alone or in combination.

As the materials suitably used in the cover 3 of the present invention, the above ionomer resin may be used alone, but the ionomer resin may be used in combination with at least one of thermoplastic elastomer, diene block copolymer and the like. Examples of the thermoplastic elastomers include polyamide thermoplastic elastomer, which is commercially available from Toray Co., Ltd. under the trade name of "Pebax" (such as "Pebax 2533"); polyester thermoplastic elastomer, which is commercially available from Toray-Do Pont Co., Ltd. under the trade name of "Hytrel" (such as "Hytrel 3548", "Hytrel 4047"); polyurethane thermoplastic elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers include an SBS (styrene-butadiene-styrene) block copolymer having polybutadiene block with epoxy groups or SIS (styrene-isoprene-styrene) block copolymer having polyisoprene block with epoxy groups and the like. Examples of the diene block copolymers which is commercially available include the diene block copolymers, which are commercially available from Daicel Chemical Industries, Ltd. under the trade name of "Epofriend" (such as "Epofriend A1010") and the like.

The amount of the thermoplastic elastomer or diene block copolymer is 1 to 60 parts by weight, preferably 1 to 35 parts by weight, based on 100 parts by weight of the base resin for the cover. When the amount is smaller than 1 parts by weight, the technical effect of absorbing the impact force at the time of hitting accomplishing by using them is not sufficiently obtained. On the other hand, when the amount is larger than 60 parts by weight, the cover is too soft and the rebound characteristics are degraded, or the compatibility with the ionomer resin is degraded and the durability is degraded.

The composition for the cover 3 used in the present invention may optionally contain pigments (such as titanium dioxide, etc.) and the other additives such as a dispersant, an antioxidant, a UV absorber, a photostabilizer and a fluorescent agent or a fluorescent brightener, etc., in addition to the resin component, as long as the addition of the additives does not deteriorate the desired performance of the golf ball cover.

A method of covering on the core 4 with the cover 3 is not specifically limited, but may be a conventional method. For example, there can be used a method comprising molding the cover composition into a semi-spherical half-shell in advance, covering the core, which is covered with the outer core, with the two half-shells, followed by pressure molding at 130 to 170° C. for 1 to 5 minutes, or a method comprising injection molding the cover composition directly on the core, which is covered with the core, to cover it. At the time of molding the cover, many depressions called "dimples" may be optionally formed on the surface of the golf ball. Furthermore, paint finishing or marking with a stamp may be optionally provided after the cover is molded for commercial purposes.

EXAMPLES

The following Examples and Comparative Examples further illustrate the present invention in detail but are not to be construed to limit the scope of the present invention.

(i) Production of Vulcanized Spherical Inner Layer Core

The rubber compositions for the inner layer core having the formulation shown in Table 1 (Examples) and Table 2 (Comparative Examples) were mixed, and then vulcanized by press-molding in the mold at the vulcanization condition shown in the same Table to obtain vulcanized spherical molded articles for the inner layer cores. The diameter, center hardness A and surface hardness B of the resulting inner layer cores were measured, and the hardness difference (B−A) was calculated. The results are shown in Table 5 (Examples) and Table 6

Comparative Examples (ii) Production of Unvulcanized Semi-spherical Half-shell for the Outer Layer Core The rubber compositions for the outer layer core having the formulation shown in Table 1 (Examples) and Table 2 (Comparative Examples) were mixed, and then press-molded in the mold (5, 6) having a semi-spherical convex having the same diameter as the vulcanized spherical molded article for the inner layer core produced in the step (i) as described in FIG. 2 to obtain unvulcanized semi-spherical half-shells 7 for the outer layer core.

(iii) Production of Core

The vulcanized spherical molded articles for the inner layer core 9 produced in the step (i) were covered with the two unvulcanized semi-spherical half-shells 7 for the outer layer core produced in the step (ii), and then vulcanized by press-molding at the vulcanization condition shown in Table 1 (Examples) and Table 2 (Comparative Examples) in the mold 8 as described in FIG. 3 to obtain two-layer structured cores 4. The surface hardness of the resulting cores 4 was measured. The results are shown in Table 5 (Examples) and Table 6 (Comparative Examples) as the surface hardness C in JIS-C hardness of the outer layer core. In addition, the inner hardness D and thickness T of the outer layer core were measured, and the hardness difference (C−D), {T(C−B)}, (60−A) and {T(C−B)−(60−A)} were calculated. The results are shown in the same Tables.

TABLE 1

(parts by weight)

| Core composition | Comparative Example No. 1 | 2 | 3 | 4 | 5 | 6 | 7 |
|---|---|---|---|---|---|---|---|
| (Inner layer core composition) | | | | | | | |
| BR-18 *1 | 100 | 100 | 100 | 100 | 100 | 100 | 100 |
| Zinc acrylate | 34.5 | 34.5 | 34.5 | 35.0 | 34.5 | 34.5 | 34.0 |
| Zinc oxide | 3 | 3 | 3 | 3 | 3 | 3 | 3 |
| Dicumyl peroxide | 0.7 | 0.7 | 0.7 | 0.7 | 0.7 | 0.7 | 0.7 |
| Diphenyl disulfide | 1 | 1 | 1 | 1 | 1 | 1 | 1 |

TABLE 1-continued (parts by weight)

| Core composition | Comparative Example No. 1 | 2 | 3 | 4 | 5 | 6 | 7 |
|---|---|---|---|---|---|---|---|
| Vulcanization condition | | | | | | | |
| (° C.) | 165 | 165 | 160 | 165 | 165 | 165 | 160 |
| (min) | 21 | 21 | 28 | 21 | 21 | 21 | 25 |
| (Outer layer core composition) | | | | | | | |
| BR-11 *2 | 80 | 80 | 80 | 80 | 80 | 80 | 80 |
| BR-10 *3 | 20 | 20 | 20 | 20 | 20 | 20 | 20 |
| Zinc acrylate | 33 | 33 | 33 | 33 | 33 | 33 | 32 |
| Zinc oxide | 21 | 21 | 21 | 21 | 21 | 21 | 21 |
| Dicumyl peroxide | 0.5 | 0.5 | 0.5 | 0.5 | 0.5 | 0.5 | 0.5 |
| Tungsten | 11 | 11 | 11 | 11 | 16 | 11 | 15 |
| Vulcanization condition | | | | | | | |
| (° C.) | 153 | 153 | 153 | 156 | 153 | 153 | 156 |
| (min) | 20 | 20 | 20 | 20 | 20 | 20 | 20 |

TABLE 2

(parts by weight)

| Core composition | Comparative Example No. 1 | 2 | 3 | 4 | 5 |
|---|---|---|---|---|---|
| (Inner layer core composition) | | | | | |
| BR-18 *1 | 100 | 100 | 100 | 100 | 100 |
| Zinc acrylate | 34.5 | 28.5 | 34.5 | 34.5 | 34.5 |
| Zinc oxide | 3 | 3 | 3 | 3 | 3 |
| Dicumyl peroxide | 0.7 | 0.7 | 0.7 | 0.7 | 0.7 |
| Diphenyl disulfide | 1 | 1 | 1 | 1 | 1 |
| Vulcanization condition | | | | | |
| (° C.) | 155 | 165 | 160 | 165 | 165 |
| (min) | 35 | 21 | 28 | 21 | 21 |
| (Outer layer core composition) | | | | | |
| BR-11 *2 | 80 | 80 | 80 | 80 | 80 |
| BR-10 *3 | 20 | 20 | 20 | 20 | 20 |
| Zinc acrylate | 33 | 33 | 33 | 33 | 33 |
| Zinc oxide | 21 | 21 | 21 | 21 | 21 |
| Dicumyl peroxide | 0.5 | 0.5 | 0.5 | 0.5 | 0.5 |
| Tungsten | 11 | 11 | 44 | 11 | 11 |
| Vulcanization condition | | | | | |
| (° C.) | 153 | 153 | 153 | 156 | 153 |
| (min) | 20 | 20 | 20 | 20 | 20 |

*1: BR-18 (trade name), high-cis polybutadiene available from JSR Co., Ltd. (Content of 1,4-cis-polybutadiene: 96.0)
*2: BR-11 (trade name), high-cis polybutadiene available from JSR Co., Ltd. (Content of 1,4-cis-polybutadiene: 96.0)
*3: BR-10 (trade name), high-cis polybutadiene available from JSR Co., Ltd. (Content of 1,4-cis-polybutadiene: 96.0)

(iv) Preparation of Cover Compositions

The formulation materials shown in Table 3 (Examples) and Table 4 (Comparative Examples) were mixed using a kneading type twin-screw extruder to obtain pelletized cover compositions. The extrusion condition was, a screw diameter of 45 mm, a screw speed of 200 rpm, and a screw L/D of 35.

The formulation materials were heated at 150 to 260° C. at the die position of the extruder.

TABLE 3

(parts by weight)

| Cover composition | Example No. 1 | 2 | 3 | 4 | 5 | 6 | 7 |
|---|---|---|---|---|---|---|---|
| Hi-milan 1555 *4 | 10 | 10 | 10 | 10 | 10 | 30 | 10 |
| Hi-milan 1605 *5 | 5 | 5 | 5 | 5 | 5 | 20 | 5 |
| Hi-milan 1855 *6 | 85 | 55 | 85 | 85 | 85 | 50 | 85 |
| Surlyn 8945 *7 | — | — | — | — | — | — | — |
| Surlyn 9945 *8 | — | — | — | — | — | — | — |
| Surlyn 6320 *9 | — | 30 | — | — | — | — | — |
| Pebax 2533 *10 | — | — | — | — | — | — | — |
| Epofriend A1010 *11 | — | — | — | — | — | — | — |

TABLE 4

(parts by weight)

| Cover composition | Comparative Example No. 1 | 2 | 3 | 4 | 5 |
|---|---|---|---|---|---|
| Hi-milan 1555 *4 | 10 | 10 | 10 | 10 | — |
| Hi-milan 1605 *5 | 5 | 5 | 5 | 5 | — |
| Hi-milan 1855 *6 | 85 | 85 | 85 | 85 | 10 |
| Surlyn 8945 *7 | — | — | — | — | 46 |
| Surlyn 9945 *8 | — | — | — | — | 34 |
| Surlyn 6320 *9 | — | — | — | — | — |
| Pebax 2533 *10 | — | — | — | — | 7 |
| Epofriend A1010 *11 | — | — | — | — | 3 |

*4: Hi-milan 1555 (trade name), ethylene-methacrylic acid copolymer ionomer resin obtained by neutralizing with sodium ion, manufactured by Mitsui Du Pont Polychemical Co., Ltd., Shore D hardness = 61, Flexural modulus = 300 MPa

*5: Hi-milan 1605 (trade name), ethylene-methacrylic acid copolymer ionomer resin obtained by neutralizing with sodium ion, manufactured by Mitsui Du Pont Polychemical Co., Ltd., Shore D hardness = 62, Flexural modulus = 310 MPa

*6: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd., Shore D hardness = 54, Flexural modulus = 87 MPa

*7: Surlyn 8945 (trade name), ethylene-methacrylic acid copolymer ionomer resin obtained by neutralizing with sodium ion, manufactured by Du Pont Co., Shore D hardness = 63, Flexural modulus = 270 MPa

*8: Surlyn 9945 (trade name), ethylene-methacrylic acid copolymer ionomer resin obtained by neutralizing with zinc ion, manufactured by Du Pont Co., Shore D hardness = 61, Flexural modulus = 220 MPa

*9: Surlyn 6320 (trade name), ethylene-methacrylic acid-n-butyl acrylate terpolymer ionomer resin obtained by neutralizing with magnesium ion, manufactured by Du Pont Co., Shore D hardness: 44, Flexural modulus = 35 MPa

*10: Pebax 2533 (trade name), polyether amide thermoplastic elastomer, manufactured by Toray Co., Ltd.

*11: Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight

Examples 1 to 7 and Comparative Examples 1 to 5

The cover composition was covered on the resulting core 4 having two-layered structure by injection molding to form a cover layer 3 having the thickness and Shore D hardness shown in Table 5 (Examples) and Table 6 (Comparative Examples). Then, paint was applied on the surface to produce golf ball having a diameter of 42.8 mm. With respect to the resulting golf balls, the coefficient of restitution, flight performance (launch angle, spin amount and flight distance (carry and total)) and shot feel were measured or evaluated. The results are shown in Table 7 (Examples) and Table 8 (Comparative Examples). The test methods are as follows.

Test Method (1) Hardness (i) JIS-C Hardness

The JIS-C hardness was measured with a JIS-C hardness meter according to JIS K 6301.

(a) Inner Layer Core Hardness

The surface hardness of the inner layer core is determined by measuring a hardness at the surface of the inner layer core, which is formed by press-molding. The center hardness of the inner layer core is determined by measuring a hardness at the center point of the inner core in section, after the resulting inner layer core is cut into two equal parts.

(b) Outer Layer Core Hardness

The surface hardness of the outer layer core is determined by measuring a hardness at the surface of the core having two-layered structure, which is formed by integrally press-molding the outer core on the inner core. The inner hardness of the outer core is determined by measuring a hardness at the central point in the thickness of the outer layer core in section, after the two-layer structured core is cut into two equal parts.

(ii) Shore D Hardness of Cover

After the golf ball is obtained by covering the core with the cover, a Shore D hardness of the cover is determined by measuring a hardness at the surface of the golf ball at 23° C. using a Shore D hardness meter according to ASTM D-2240-68.

(2) Flight Performance (2-1) After a No.1 wood club (W#1, a driver) having a metal head was mounted to a swing robot manufactured by Golf Laboratory Co. and the golf ball was hit at a head speed of 49 m/sec, the flight distance was measured. As the flight distance, carry that is a distance to the dropping point of the hit golf ball and total that is a distance to the stop point of the hit golf ball were measured. The measurement was conducted 12 times for each golf ball (n=12), and the average is shown as the result of the golf ball.

(2-2) After a No.5 iron club (I#5) was mounted to a swing robot manufactured by Golf Laboratory Co. and the golf ball was hit at a head speed of 41 m/sec, the launch angle, spin amount and flight distance were measured. The spin amount was measured by continuously taking a photograph of a mark provided on the hit golf ball using a high-speed camera. As the flight distance, carry that is a distance to the dropping point of the hit golf ball and total that is a distance to the stop point of the hit golf ball were measured. The measurement was conducted 12 times for each golf ball (n=12), and the average is shown as the result of the golf ball.

(2-3) After a sand wedge (SW) was mounted to a swing robot manufactured by Golf Laboratory Co. and the golf ball was hit at a head speed of 21 m/sec, the launch angle and spin amount were measured. The spin amount was measured by continuously taking a photograph of a mark provided on the hit golf ball using a high-speed camera. The measurement was conducted 12 times for each golf ball (n=12), and the average is shown as the result of the golf ball.

(3) Shot Feel

The shot feel of the golf ball is evaluated by 10 golfers according to a practical hitting test using a No. 1 wood club (W#1, a driver) having a metal head. The evaluation criteria are as follows. The results shown in the Tables below are based on the fact that the most golfers evaluated with the same criterion about shot feel.

Evaluation Criteria I (Impact Force)

o: The golfers felt that the golf ball has small impact force, and good shot feel.

Δ: The golfers felt that the golf ball has slightly large impact force, and fairly good shot feel.

x: The golfers felt that the golf ball has large impact force, and poor shot feel.

Evaluation criteria II (Rebound characteristics)

o: The golfers felt that the golf ball has rebound characteristics, and good shot feel.

Δ: The golfers felt that the golf ball has small rebound characteristics, and slightly heavy and fairly good shot feel.

x: The golfers felt that the golf ball has not rebound characteristics, and heavy and poor shot feel.

TABLE 5

| Test item | Example No. 1 | 2 | 3 | 4 | 5 | 6 | 7 |
|---|---|---|---|---|---|---|---|
| Diameter of inner layer core (mm) | 31.4 | 31.4 | 31.4 | 31.4 | 33.0 | 31.4 | 30.0 |
| Thickness of outer layer core T (mm) | 3.8 | 3.8 | 3.8 | 3.8 | 3.0 | 3.8 | 4.5 |
| Total thickness of cover (mm) | 1.9 | 1.9 | 1.9 | 1.9 | 1.9 | 1.9 | 1.9 |
| Thickness of the outermost layer of cover (mm) | 1.9 | 1.9 | 1.9 | 1.9 | 1.9 | 1.9 | 1.9 |
| JIS-C hardness of inner layer core | | | | | | | |
| Center hardness A | 55 | 55 | 59 | 55 | 55 | 55 | 57 |
| Surface hardness B | 82 | 82 | 82 | 83 | 82 | 82 | 80 |
| Hardness difference (B − A) | 27 | 27 | 23 | 28 | 27 | 27 | 23 |

TABLE 5-continued

| Test item | Example No. 1 | 2 | 3 | 4 | 5 | 6 | 7 |
|---|---|---|---|---|---|---|---|
| JIS-C hardness of outer layer core | | | | | | | |
| Surface hardness C | 84 | 84 | 84 | 86 | 84 | 84 | 82 |
| Inner hardness D | 83.5 | 83.5 | 83.5 | 85 | 83.5 | 83.5 | 80.5 |
| Hardness difference (C − D) | 0.5 | 0.5 | 0.5 | 1.0 | 0.5 | 0.5 | 1.5 |
| T (C − B) | 7.6 | 7.6 | 7.6 | 11.4 | 6.0 | 7.6 | 9.0 |
| (60 − A) | 5 | 5 | 1 | 5 | 5 | 5 | 3 |
| {T(C − B) − (60 − A)} | 2.6 | 2.6 | 6.6 | 6.4 | 1 | 2.6 | 6.0 |
| Hardness of the outermost layer of cover | | | | | | | |
| Shore D hardness | 59 | 57 | 59 | 59 | 59 | 61 | 59 |

TABLE 6

| Test item | Comparative Example No. 1 | 2 | 3 | 4 | 5 |
|---|---|---|---|---|---|
| Diameter of inner layer core (mm) | 31.4 | 31.4 | 36 | 31.4 | 31.4 |
| Thickness of outer layer core T (mm) | 3.8 | 3.8 | 1.5 | 3.4 | 3.8 |
| Total thickness of cover (mm) | 1.9 | 1.9 | 1.9 | 2.3 | 1.9 |
| Thickness of the outermost layer of cover (mm) | 1.9 | 1.9 | 1.9 | 2.3 | 1.9 |
| JIS-C hardness of inner layer core | | | | | |
| Center hardness A | 62 | 55 | 59 | 55 | 55 |
| Surface hardness B | 82 | 74 | 82 | 82 | 82 |
| Hardness difference (B − A) | 20 | 19 | 23 | 27 | 27 |
| JIS-C hardness of outer layer core | | | | | |
| Surface hardness C | 84 | 84 | 84 | 84 | 84 |
| Inner hardness D | 83.5 | 83.5 | 83.5 | 83.5 | 83.5 |
| Hardness difference (C − D) | 0.5 | 0.5 | 0.5 | 0.5 | 0.5 |
| T (C − B) | 7.6 | 38 | 3 | 6.8 | 7.6 |
| (60 − A) | −2 | 5 | 1 | 5 | 5 |
| {T(C − B) − (60 − A)} | 9.6 | 33 | 2 | 1.8 | 2.6 |
| Hardness of the outermost layer of cover | | | | | |
| Shore D hardness | 59 | 59 | 59 | 59 | 65 |

TABLE 7

| Test item | Example No. 1 | 2 | 3 | 4 | 5 | 6 | 7 |
|---|---|---|---|---|---|---|---|
| Flight performance 1 (W#1; 49 m/s) | | | | | | | |
| Carry (yard) | 254.9 | 255.2 | 255.4 | 255.8 | 254.0 | 255.8 | 254.0 |
| Total (yard) | 272.3 | 271.3 | 272.8 | 273.3 | 271.2 | 273.4 | 271.0 |
| Flight performance 2 (I#5; 41 m/s) | | | | | | | |
| Launch angle (degree) | 14.41 | 14.34 | 14.28 | 14.43 | 14.38 | 14.50 | 14.30 |
| Spin amount (rpm) | 4769 | 5019 | 4890 | 4689 | 4980 | 4650 | 5030 |
| Carry (yard) | 200.4 | 196.9 | 198.8 | 201.2 | 199.5 | 202.5 | 198.5 |
| Total (yard) | 208.8 | 206.8 | 207.3 | 209.5 | 207.8 | 210.3 | 206.3 |
| Flight performance 3 (SW; 21 m/s) | | | | | | | |
| Launch angle (degree) | 29.96 | 29.45 | 29.58 | 29.99 | 29.78 | 30.25 | 29.43 |
| Spin amount (rpm) | 6433 | 6618 | 6581 | 6320 | 6388 | 6230 | 6615 |
| Shot feel | | | | | | | |
| I | ○ | ○ | ○ | ○ | ○ | ○ | ○ |
| II | ○ | ○ | ○ | ○ | ○ | ○ | ○ |

TABLE 8

| Test item | Comparative Example No. 1 | 2 | 3 | 4 | 5 |
|---|---|---|---|---|---|
| Flight performance 1 (W#1; 49 m/s) | | | | | |
| Carry (yard) | 255.9 | 252.8 | 252.2 | 251.3 | 255.8 |
| Total (yard) | 273.4 | 268.6 | 269.5 | 267.5 | 273.9 |
| Flight performance 2 (I#5; 41 m/s) | | | | | |
| Launch angle (degree) | 14.18 | 14.51 | 14.30 | 14.10 | 14.51 |
| Spin amount (rpm) | 5125 | 4658 | 4821 | 5312 | 4550 |
| Carry (yard) | 194.8 | 193.5 | 198.5 | 192.3 | 202.8 |
| Total (yard) | 204.8 | 203.9 | 206.9 | 202.6 | 211.0 |
| Flight performance 3 (SW; 21 mn/s) | | | | | |
| Launch angle (degree) | 30.16 | 30.08 | 30.05 | 29.12 | 30.35 |
| Spin amount (rpm) | 6252 | 6250 | 6320 | 6725 | 6000 |
| Shot feel | | | | | |
| I | Δ | ○ | ○ | ○ | x |
| II | ○ | x | Δ | Δ | ○ |

In the golf balls of the present invention of Examples 1 to 7, when compared with the golf balls of Comparative Examples 1 to 5, the flight distance is long when hit by a No. 1 wood club; the launch angle is high, the spin amount is low, and the flight distance is long when hit by a No. 5 iron club; the spin amount is high when hit by a sand wedge; and the shot feel is good.

On the other hand, in the golf ball of Comparative Example 1, since the center hardness of the inner layer core is high, the shot feel is hard and poor; the launch angle is low and the flight distance is short when hit by a No. 5 iron club.

In the golf ball of Comparative Example 2, since the value of {T(C−B)−(60−A)} is large, the rebound characteristics are degraded, which reduces the flight distance. In addition, since the value of {T(C−B)−(60−A)} is large and the hardness difference (B−A) is small, golfers feel that the golf ball has not rebound characteristics, and the shot feel is heavy and poor.

In the golf ball of Comparative Example 3, the thickness of the outer layer core is too small, and the flight distance is short when hit by a driver. In addition, golfers feel that the golf ball has not rebound characteristics, and the shot feel is heavy and poor.

In the golf ball of Comparative Example 4, since the thickness of the outermost layer of cover is large, the rebound characteristics are degraded; the launch angle is low and the spin amount is large when hit by a driver and a middle iron club, which reduces the flight distance. In addition, golfers feel that the golf ball has not rebound characteristics, and the shot feel is heavy and poor.

In the golf ball of Comparative Example 5, since the hardness of the outermost layer of cover is high, the spin amount is low particularly when hit by a sand wedge; and the impact force at the time of hitting is large, and the shot feel is poor.

What is claimed is:

1. A multi-piece solid golf ball comprising:

a core composed of an inner layer core and an outer layer core formed on the inner layer, and at least one layer of a cover formed on the core, wherein the inner layer core has a diameter of 24 to 40 mm and a center hardness in JIS-C hardness of 40 to 60, a surface hardness in JIS-C hardness of the inner layer core higher than the center hardness by 20 to 40, the outer layer core having a thickness of 2.0 to 7.0 mm and a surface hardness in JIS-C hardness of 75 to 90, and the outermost layer of the cover has a thickness of 1.0 to 2.0 mm and a Shore D of 40 to 63, and assuming that the center hardness and surface hardness in JIS-C hardness of the inner layer core are represented as A and B respectively, and the surface hardness in JIS-C hardness and the thickness of the outer layer core are represented as C and T respectively, the golf ball satisfies the following formula:

$$0 \leqq \{T(C-B)-(60-A)\} \leqq 10; \text{ and}$$

the difference between the surface hardness of the outer layer core and the inner hardness at the central point in the thickness of the outer layer core is not more than 2.

2. The multi-piece solid golf ball according to claim 1, wherein the difference between the surface hardness of the outer layer core and the inner hardness at the central point in thickness of the outer layer core is within the range of 1.0 to 2.

3. The multi-piece solid golf ball according to claim 1, wherein the difference in hardness between the surface hardness of the outer layer core and the inner hardness at the central point in thickness of the outer layer core is 1.5.

* * * * *